US008546058B2

(12) United States Patent
Mizuguchi et al.

(10) Patent No.: US 8,546,058 B2
(45) Date of Patent: Oct. 1, 2013

(54) ELECTROSTATIC LATENT IMAGE DEVELOPING TONER, ELECTROSTATIC LATENT IMAGE DEVELOPER, IMAGE FORMING APPARATUS, AND APPARATUS FOR MANUFACTURING ELECTROSTATIC LATENT IMAGE DEVELOPING TONER

(71) Applicant: Fuji Xerox Co., Ltd., Tokyo (JP)

(72) Inventors: Takahiro Mizuguchi, Minamiashigara (JP); Hiroshi Takano, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/669,054

(22) Filed: Nov. 5, 2012

(65) Prior Publication Data

US 2013/0089359 A1 Apr. 11, 2013

Related U.S. Application Data

(63) Continuation of application No. 11/905,837, filed on Oct. 4, 2007, now abandoned.

(30) Foreign Application Priority Data

Mar. 13, 2007 (JP) ..... 2007-064163

(51) Int. Cl.
*G03G 9/08* (2006.01)

(52) U.S. Cl.
USPC ..... 430/137.14; 523/335; 264/117

(58) Field of Classification Search
USPC ..... 430/137.14; 523/335; 264/117
See application file for complete search history.

(56) References Cited

U.S. PATENT DOCUMENTS

| | | | |
|---|---|---|---|
| 4,264,697 | A | 4/1981 | Perez et al. |
| 6,537,715 | B2 | 3/2003 | Mizoo et al. |
| 6,703,176 | B2 | 3/2004 | Naka et al. |

(Continued)

FOREIGN PATENT DOCUMENTS

| | | |
|---|---|---|
| JP | A-56-011461 | 2/1981 |
| JP | A-62-039879 | 2/1987 |

(Continued)

OTHER PUBLICATIONS

Sep. 6, 2011 Japanese Office Action issued in Japanese Patent Application No. 2007-064163.

(Continued)

*Primary Examiner* — Christopher Rodee
(74) *Attorney, Agent, or Firm* — Oliff & Berridge, PLC

(57) ABSTRACT

A method for forming an electrostatic latent image developing toner including mixing in a stirring tank a resin particle dispersion with at least a colorant particle dispersion prepared by dispersing a colorant and in some cases with a release agent particle dispersion prepared by dispersing a release agent; aggregating in the stirring tank the resin particles with the pigment particles and the release agent particles to form aggregate particles; and then conducting heating in the stirring tank to fuse the aggregate particles, wherein the method further comprises during a fusion step, suppressing with an accumulation suppression unit accumulation of aggregate particles. The accumulation suppression unit is a magnetic field forming unit that forms a magnetic field either continuously or intermittently. The toner has an average sphericity of at least 0.94 but no more than 0.98 and particle characteristics as defined in the specification.

8 Claims, 2 Drawing Sheets

(56) References Cited

U.S. PATENT DOCUMENTS

| | | | | |
|---|---|---|---|---|
| 7,413,841 | B2 * | 8/2008 | Yuasa | 430/137.14 |
| 2002/0037468 | A1 | 3/2002 | Matsushima et al. | |
| 2002/0072006 | A1 | 6/2002 | Mizoo et al. | |
| 2002/0106219 | A1 | 8/2002 | Sakai et al. | |
| 2003/0003387 | A1 * | 1/2003 | Xu et al. | 430/137.14 |
| 2003/0054278 | A1 * | 3/2003 | Naka et al. | 430/110.3 |
| 2003/0096185 | A1 | 5/2003 | Yamashita et al. | |
| 2003/0122911 | A1 | 7/2003 | Mizoo et al. | |
| 2003/0148204 | A1 | 8/2003 | Ohmura et al. | |
| 2006/0216629 | A1 | 9/2006 | Miyakawa et al. | |
| 2007/0020553 | A1 * | 1/2007 | Marcello et al. | 430/137.14 |

FOREIGN PATENT DOCUMENTS

| | | |
|---|---|---|
| JP | A-2000-347463 | 12/2000 |
| JP | A-2002-014486 | 1/2002 |
| JP | A-2002-278161 | 9/2002 |
| JP | A-2002-357925 | 12/2002 |
| JP | A-2003-029459 | 1/2003 |
| JP | A-2003-043723 | 2/2003 |
| JP | A-2004-198752 | 7/2004 |
| JP | A-2005-215148 | 8/2005 |
| JP | A-2006-293310 | 10/2006 |

OTHER PUBLICATIONS

Diamond, Arthur S. and Weiss, David S. (eds.), Handbook of Imaging Materials, 2nd ed., New York: Marcel-Dekker, Inc. (Nov. 2001) pp. 145-164.

Diamond, Arthur S. and Weiss, David S. (eds.), Handbook of Imaging Materials, 2nd ed., New York: Marcel-Dekker, Inc. (Nov. 2001) pp. 209-219.

* cited by examiner

ELECTROSTATIC LATENT IMAGE DEVELOPING TONER, ELECTROSTATIC LATENT IMAGE DEVELOPER, IMAGE FORMING APPARATUS, AND APPARATUS FOR MANUFACTURING ELECTROSTATIC LATENT IMAGE DEVELOPING TONER

CROSS-REFERENCE TO RELATED APPLICATIONS

This application is a Continuation of application Ser. No. 11/905,837 filed Oct. 4, 2007, which is based on and claims priority under 35 USC 119 from Japanese Patent Application No. 2007-064163, filed on Mar. 13, 2007. The disclosure of the prior application is hereby incorporated by reference herein in its entirety.

BACKGROUND

1. Technical Field

The present relates to an electrostatic latent image developing toner (hereafter also referred to as an electrophotographic toner), an electrostatic latent image developer, an image forming apparatus, and an apparatus for manufacturing an electrostatic latent image developing toner.

2. Related Art

Methods of visualizing image information by using an electrostatic latent image, such as electrophotographic methods, are currently used in a wide variety of fields. In an electrophotographic method, an electrostatic image is formed on a photoreceptor by charging and exposure, this electrostatic image is developed with a developer that includes a toner, and the toner image is then transferred and fixed to complete visualization of the image. Developers that can be used in this type of electrophotographic method include two-component developers that are formed from a combination of a toner and a carrier, and one-component developers in which a magnetic toner or non-magnetic toner is used alone. The method of manufacturing the toner usually employs a kneading-grinding method in which a thermoplastic resin is subjected to melt kneading with a pigment, a charge control agent and a release agent such as a wax, and the resulting mixture is subsequently cooled, grinded finely, and then classified. If required, inorganic or organic particles may then be added to the toner and adhered to the surface of the toner particles in order to improve the toner fluidity and cleaning properties.

In a typical kneading-grinding method, although only minor variations occur in the grindability of the materials used and the conditions during the grinding step, the toner shape and the toner surface structure are irregular, and systematic control of the toner shape and surface structure is difficult. Furthermore, particularly in the case of toners that employ materials with a high degree of grindability, the toner particles are often ground further by mechanical forces within the developing unit, thereby inviting the generation of a very fine powder and causing variation in the shape of the toner. As a result of these effects, charge degradation of the developer caused by the fine powder affixing to the surface of the carrier tends to occur in two-component developers, whereas in one-component developers, the broadening of the particle size distribution tends to cause toner scatter, and the variation in toner shape tends to cause a deterioration in the developability that increases the possibility of image degradation.

On the other hand, in recent years there has been a shift to the use of toners manufactured using polymerized methods. In a polymerized method, a spherical toner is usually obtainable. One feature of spherical toners is that they offer a high degree of transferability. However, in a suspension polymerization method, the preparation of irregularly shaped toner particles is problematic, and the average sphericity is usually 0.98 or higher. Although spherical toner with a sphericity of 0.98 or higher exhibits a high degree of transferability, when residual non-transferred toner left on the photoreceptor needs to be removed by cleaning, satisfactory cleaning may not be achievable using a normal blade cleaning technique.

SUMMARY

According to an aspect of the present invention, there is provided an electrostatic latent image developing toner in which the average sphericity is at least 0.94 but no more than 0.98, the particle at the point where the accumulated equivalent spherical diameter, counted upwards on a number basis from the particle of smallest sphericity, reaches 90% has a sphericity of less than 0.92, the proportion of particles within the entire toner having a sphericity of less than 0.92 is less than 3% by number of particles, the proportion of particles having a sphericity of at least 0.90 but less than 0.95 is at least 20% but no more than 40% of the entire toner, and the proportion of particles having a sphericity of at least 0.95 but no more than 1.00 is at least 60% but no more than 80% of the entire toner.

BRIEF DESCRIPTION OF THE DRAWINGS

Exemplary embodiment(s) of the present invention will be described in detail based on the following figures, wherein.

DETAILED DESCRIPTION

[Electrostatic Latent Image Developing Toner]

Figure 1:
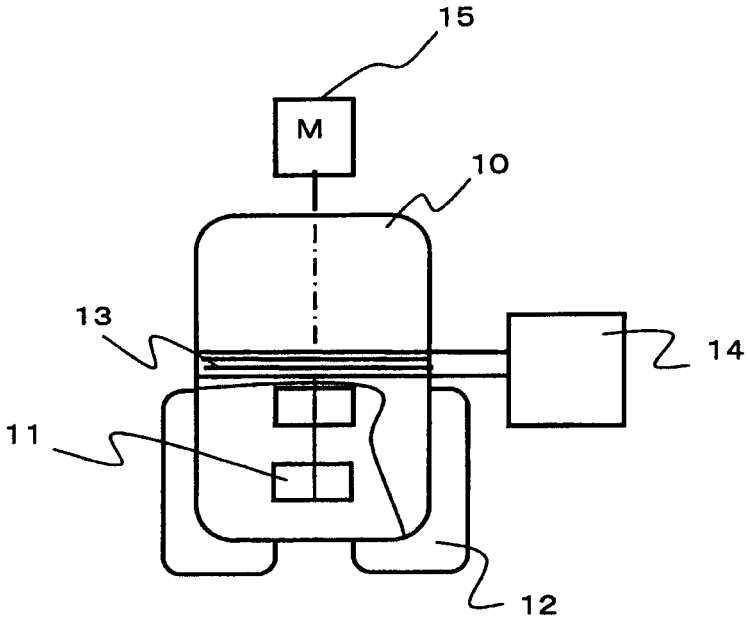
FIG. 1 is a partially cutaway schematic illustration showing one example of the structure of a stirring tank used in a fusion step within an apparatus for manufacturing toner particles according to an exemplary embodiment of the present invention.

An electrostatic latent image developing toner (hereafter also referred to simply as "toner") of the exemplary embodiment is a toner in which the average sphericity is at least 0.94 but no more than 0.98, the particle at the point where the accumulated equivalent spherical diameter, counted upwards on a number basis from the particle of smallest sphericity, reaches 90% has a sphericity of less than 0.92, the proportion of particles within the entire toner having a sphericity of less than 0.92 is less than 3% by number of particles, the proportion of particles having a sphericity of at least 0.90 but less than 0.95 is at least 20% but no more than 40% of the entire toner, and the proportion of particles having a sphericity of at least 0.95 but no more than 1.00 is at least 60% but no more than 80% of the entire toner.

If the average sphericity is less than 0.94, then there are considerable irregularities in the shape of the toner particles, which although improving the cleaning properties, may cause a deterioration in the toner chargeability and fluidity, resulting in a deterioration in the transferability of the toner. In contrast, an average sphericity exceeding 0.98 indicates a high level of sphericity for the toner particles, which although improving the transferability of the toner, tends to cause a deterioration in the cleaning properties.

Furthermore, if the particle at the point where the accumulated equivalent spherical diameter, counted upwards on a number basis from the particle of smallest sphericity, reaches 90% has a sphericity of less than 0.92, but the proportion of particles within the entire toner having a sphericity of less than 0.92 is at least 3% by number of particles, then the adhesion of the toner to the carrier is weak, meaning the toner is prone to scattering, which can cause contamination inside the developing unit and/or of the formed image. Because particles above 90% with a sphericity of less than 0.92 have a small chargeable surface area for contact with the carrier, and are consequently prone to toner scatter, if the proportion of these large diameter, irregularly shaped particles exceeds 3% of the entire toner, then the interior of the developing unit and the formed image may be prone to contamination.

Furthermore, in the toner, in those cases where either the proportion of particles having a sphericity of at least 0.90 but less than 0.95 is outside the range from at least 20% to no more than 40% of the entire toner, or the proportion of particles having a sphericity of at least 0.95 but no more than 1.00 is outside the range from at least 60% to no more than 80% of the entire toner, for example in the case where the proportion of particles with an average sphericity of at least 0.90 but less than 0.95 is less than 20%, then the effect of the toner in assisting the cleaning of spherical particles is not achieved, meaning unsatisfactory cleaning may occur. Furthermore, if the proportion of particles with an average sphericity within a range from 0.90 to 0.95 exceeds 40%, then because the average sphericity of the toner falls outside the range specified by the present invention, transfer faults tend to occur. Furthermore, if the proportion of particles with an average sphericity within a range from 0.95 to 1.0 is less than 60%, then the number of irregularly shaped particles is large, causing a deterioration in the developability and transferability. Moreover, if the proportion of particles with an average sphericity within a range from 0.95 to 1.0 exceeds 80%, then because the quantity of particles cleaned without the assistance provided by irregularly shaped particles is minimal, problems of unsatisfactory cleaning may occur.

The measurements of the aforementioned average sphericity of the toner particles, and the accumulated equivalent spherical diameter counted on a number basis are described below.

A polymerization method is particularly effective as the method of manufacturing an electrostatic latent image developing toner according to the present exemplary embodiment. This wet toner manufacturing method (chemical toner manufacturing method) is a method such as an emulsion polymerization aggregation method, suspension polymerization method, or melt suspension method, wherein a resin and monomer components are placed in a water-based medium, and the toner is produced via emulsification, dispersion, and where necessary polymerization.

One example of a method of manufacturing an electrostatic latent image developing toner according to the present exemplary embodiment is a so-called emulsion polymerization method, which is a method that includes, for example, (i) preparing a resin particle dispersion by polymerizing, in a water-based solvent, a polymerizable monomer that includes a polymerizable monomer having a vinyl-based double bond, and (ii) mixing the resin particle dispersion with at least a colorant particle dispersion prepared by dispersing a colorant, and in some cases with a release agent particle dispersion prepared by dispersing a release agent, aggregating the resin particles with the pigment particles and the release agent particles to form aggregate particles, and then conducting heating to fuse the aggregate particles.

Examples of monomers containing a radical polymerizable vinyl group include aromatic vinyl monomers, (meth)acrylate ester monomers, vinyl ester monomers, vinyl ether monomers, monoolefin monomers, diolefin monomers, and halogenated olefin monomers. Specific examples of suitable aromatic vinyl monomers include styrene monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene. Specific examples of suitable (meth)acrylate ester monomers include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, and diethylaminoethyl methacrylate. Specific examples of suitable vinyl ester monomers include vinyl acetate, vinyl propionate and vinyl benzoate. Specific examples of suitable vinyl ether monomers include vinyl methyl ether, vinyl ethyl ether, vinyl isobutyl ether and vinyl phenyl ether. Specific examples of suitable monoolefin monomers include ethylene, propylene, isobutylene, 1-butene, 1-pentene, and 4-methyl-1-pentene. Specific examples of suitable diolefin monomers include butadiene, isoprene and chloroprene. Specific examples of suitable halogenated olefin monomers include vinyl chloride, vinylidene chloride and vinyl bromide. The above list is no way limiting, and the monomer may use either a single monomer or a combination of two or more different monomers.

Moreover, the polymerization of the above monomers may be conducted using conventional polymerization methods such as emulsion polymerization methods, mini-emulsion methods, suspension polymerization methods and dispersion polymerization methods, and may include other components such as initiators, emulsifiers and stabilizers, so that the polymerization itself in no way restricts the present invention.

In the aggregation step of emulsifying or dispersing these resin particles, the aforementioned resin particle dispersion is mixed in a water-based medium, together with a colorant particle dispersion and a release agent dispersion where required, a coagulant is added, and the particles are subjected to hetero-aggregation, thereby enabling formation of aggregated particles of toner particle size. Furthermore, following aggregation in this manner to form primary aggregate particles, a dispersion of fine particles of a different polymer may be added, enabling formation of a secondary shell layer on the surface of the primary particles. In this example, the colorant dispersion is prepared separately, but in those cases where the colorant is added in advance to the resin particles, the use of a separate colorant dispersion is unnecessary.

Subsequently, in the fusion step, the resin particles are heated to a temperature at least as high as the glass transition temperature or melting temperature of the resin that constitutes the resin particles, thereby fusing the aggregate particles, and the fused particles are then washed if necessary and dried to yield the toner particles. The shape of the toner particles may be any shape from amorphous particles through to spherical particles. Examples of preferred coagulants include not only surfactants, but also inorganic salts and bivalent or higher metal salts. The use of metal salts is particularly preferred in terms of factors such as controlling the aggregation properties and achieving favorable toner chargeability.

In the manufacturing method of the present exemplary embodiment, during the fusion step, a magnetic field is formed either continuously or intermittently within the stirring tank that contains the aggregate particles, thereby suppressing accumulation of aggregate particles within the stirring tank, for example, by generating a repulsive force between the internal surfaces of the stirring tank and the aggregate particles. This configuration is described in further detail below within the description of a manufacturing apparatus of the present invention.

Furthermore, another example of a method of manufacturing an electrostatic latent image developing toner according to the present exemplary embodiment is a method that includes, for example, a step of mixing together a resin particle dispersion prepared by emulsifying a mixture of a crystalline polyester resin and a amorphous polyester resin, a release agent dispersion and a colorant dispersion, and then aggregating the mixture using a coagulant, and a step of conducting fusion by heating to a temperature at least as high as the glass transition temperature (Tg) of the amorphous polyester resin but no higher than the melting temperature of the release agent.

In the fusion step of the above alternative manufacturing method, a magnetic field is formed either continuously or intermittently within the stirring tank that contains the aggregate particles, thereby suppressing accumulation of aggregate particles within the stirring tank, for example, by generating a repulsive force between the internal surfaces of the stirring tank and the aggregate particles. This configuration is described in further detail below within the description of a manufacturing apparatus of the present invention.

—Crystalline Polyester Resin—

In this description, the term "crystalline polyester resin" refers to a resin that exhibits a clear endothermic peak rather than a stepwise variation in the quantity of heat absorption when measured using differential scanning calorimetry (DSC). A clear endothermic peak refers to a peak in which the DSC curve moves away from the preceding baseline and then returns to the baseline, as disclosed in the "Method of Measuring the Transition Temperature of Plastics" detailed in JIS K 7121-1987. In an electrostatic latent image developing toner according to the present invention, the term "crystalline" describes a resin that exhibits a clear endothermic peak when measured using differential scanning calorimetry (DSC), and more specifically, describes a resin for which the full width at half maximum of the endothermic peak obtained upon measurement at a rate of temperature increase of 10° C./minute is no more than 6° C.

Specifically, aliphatic crystalline polyester resins having a suitable melting temperature and containing alkyl groups of 6 or more carbon atoms as side chains are particularly preferred as the crystalline polyester resin. Polyester resins containing alkyl groups of 6 or more carbon atoms can be obtained by using a monomer having an alkyl group of 6 or more carbon atoms as either the polyvalent carboxylic acid or the polyhydric alcohol described below. One suitable example is dodecenylsuccinic acid, although the present invention is not restricted to use of this compound.

The crystalline polyester resin is obtained mainly through a condensation polymerization of a polyvalent carboxylic acid and a polyhydric alcohol. In the present invention, a copolymer in which another component is introduced into the principal chain of the crystalline polyester resin in a proportion of no more than 50% by mass is also referred to as a crystalline polyester.

Examples of the polyvalent carboxylic acid used in the production of the polyester resin used in the exemplary embodiment of the present invention include aromatic dicarboxylic acids such as terephthalic acid, isophthalic acid, orthophthalic acid, 1,5-naphthalenedicarboxylic acid, 2,6-naphthalenedicarboxylic acid and diphenic acid, aromatic oxycarboxylic acids such as p-oxybenzoic acid and p-(hydroxyethoxy)benzoic acid, aliphatic dicarboxylic acids such as succinic acid, alkylsuccinic acids, alkenylsuccinic acids, adipic acid, azelaic acid, sebacic acid and dodecanedicarboxylic acid, unsaturated aliphatic and alicyclic dicarboxylic acids such as fumaric acid, maleic acid, itaconic acid, mesaconic acid, citraconic acid, hexahydrophthalic acid, tetrahydrophthalic acid, dimer acid, trimer acid, hydrogenated dimer acid, cyclohexanedicarboxylic acid and cyclohexenedicarboxylic acid, as well as trivalent or higher polyvalent carboxylic acids such as trimellitic acid, trimesic acid and pyromellitic acid.

Examples of the polyhydric alcohol used in the production of the polyester resin include aliphatic polyhydric alcohols, alicyclic polyhydric alcohols and aromatic polyhydric alcohols. Specific examples of suitable aliphatic polyhydric alcohols include aliphatic diols such as ethylene glycol, propylene glycol, 1,3-propanediol, 2,3-butanediol, 1,4-butanediol, 1,5-pentanediol, 1,6-hexanediol, neopentyl glycol, diethylene glycol, dipropylene glycol, dimethylolheptane, 2,2,4-trimethyl-1,3-pentanediol, polyethylene glycol, polypropylene glycol, polytetramethylene glycol, and lactone-based polyester polyols obtained by ring-opening polymerization of a lactone such as ∈-caprolactone, as well as triols and tetraols such as trimethylolethane, trimethylolpropane, glycerol and pentaerythritol.

Specific examples of suitable alicyclic polyhydric alcohols include 1,4-cyclohexanediol, 1,4-cyclohexanedimethanol, spiroglycol, hydrogenated bisphenol A, ethylene oxide adducts and propylene oxide adducts of hydrogenated bisphenol A, tricyclodecanediol, tricyclodecanedimethanol, dimer diol and hydrogenated dimer diol.

Specific examples of suitable aromatic polyhydric alcohols include paraxylene glycol, metaxylene glycol, orthoxylene glycol, 1,4-phenylene glycol, ethylene oxide adducts of 1,4-phenylene glycol, bisphenol A, and ethylene oxide adducts and propylene oxide adducts of bisphenol A.

A monofunctional monomer may also be introduced into the polyester resin in order to block the polar groups at the polyester resin terminals, thereby improving the environmental stability of the toner charge characteristics. Examples of suitable monofunctional monomers include monocarboxylic acids such as benzoic acid, chlorobenzoic acid, bromobenzoic acid, parahydroxybenzoic acid, the monoammonium salt of sulfobenzoic acid, the monosodium salt of sulfobenzoic acid, cyclohexylaminocarbonylbenzoic acid, n-dodecylaminocarbonylbenzoic acid, tertiary-butylbenzoic acid, naphthalenecarboxylic acid, 4-methylbenzoic acid, 3-methylbenzoic acid, salicylic acid, thiosalicylic acid, phenylacetic acid, acetic acid, propionic acid, butyric acid, isobutyric acid, octanecarboxylic acid, lauric acid, stearic acid, and lower alkyl esters of the above acids, as well as monoalcohols including aliphatic alcohols, aromatic alcohols and alicyclic alcohols.

There are no particular restrictions on the method used for producing the crystalline polyester resin, and a typical polyester polymerization method in which the acid component and the alcohol component are reacted together is suitable. Specific examples include direct polycondensation methods and transesterification methods, and the method used may be selected in accordance with the nature of the monomers.

Production of the crystalline polyester resin can be conducted at a polymerization temperature within a range from 180 to 230° C., and if necessary the pressure within the reaction system may be reduced, so that the water and alcohol generated during the condensation is removed while the reaction proceeds. In those cases where the monomers do not dissolve or are not compatible at the reaction temperature, a high boiling temperature solvent may be used as a dissolution assistant for dissolving the monomers. In a polycondensation reaction, the dissolution assistant is removed as the reaction proceeds. If a monomer with poor compatibility exists within a copolymerization reaction, then that monomer with poor compatibility may be first subjected to condensation with the acid or alcohol with which the monomer is to undergo polycondensation, and the resulting product then subjected to polycondensation with the primary component.

Examples of catalysts that may be used during production of the crystalline polyester resin include compounds of alkali metals such as sodium and lithium; compounds of alkaline earth metals such as magnesium and calcium; compounds of other metals such as zinc, manganese, antimony, titanium, tin, zirconium and germanium; as well as phosphite compounds, phosphate compounds, and amine compounds. Specific examples include the compounds listed below.

Namely, specific examples include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconium carbonate, zirconium acetate, zirconium stearate, zirconium octylate, germanium oxide, triphenyl phosphite, tris(2,4-t-butylphenyl) phosphite, ethyltriphenylphosphonium bromide, triethylamine, and triphenylamine. The quantity added of this type of catalyst is preferably within a range from 0.01 to 1.00% by weight relative to the combined weight of the raw materials.

The melting temperature of the crystalline resin is preferably within a range from 50 to 120° C., and even more preferably from 60 to 110° C. If the melting temperature is lower than 50° C., then problems may arise in terms of the storage properties of the toner, or the storage properties of the toner image following fixing. In contrast, if the melting temperature is higher than 120° C., then the low-temperature fixing may be unsatisfactory when compared with conventional toners.

In this description, the melting temperature of the crystalline resin is measured using a differential scanning calorimeter (DSC). The melting temperature is obtained as a melting peak temperature within a differential scanning calorimetry method conducted in accordance with ASTM D3418-8, when measurement is conducted from room temperature to 150° C. at a rate of temperature increase of 10° C. per minute. Measurement of the glass transition temperature of the amorphous polyester resin described below can be conducted in a similar manner.

Furthermore, although the crystalline resin may exhibit multiple melting peaks in some cases, in the present invention, the maximum peak is regarded as the melting temperature.

Moreover, the measurement of resin melting temperatures in the present invention can be conducted, for example, using a DSC-7 device manufactured by PerkinElmer Inc. In this device, temperature correction at the detection unit is conducted using the melting temperatures of indium and zinc, and correction of the heat quantity is conducted using the heat of fusion of indium. The sample is placed in an aluminum pan, and using an empty pan as a control, measurement is conducted at a rate of temperature increase of 10° C./minute. Measurement of the softening temperature of the amorphous polyester resin described below can be conducted in a similar manner.

—Amorphous Polyester Resin—

The amorphous polyester resin is obtained mainly through a condensation polymerization of an aforementioned polyvalent carboxylic acid and polyhydric alcohol, using one of the catalysts described above.

The amorphous resin polyester resin can be produced by a condensation reaction of an aforementioned polyhydric alcohol and polyvalent carboxylic acid using conventional methods. In one example of a production method, the polyhydric alcohol, the polyvalent carboxylic acid, and where necessary a catalyst, are blended together in a reaction vessel fitted with a thermometer, a stirrer and a reflux condenser, the mixture is heated to a temperature of 150 to 250° C. under an inert gas atmosphere (of nitrogen gas or the like), and the reaction is continued until a predetermined acid value is reached, while by-product low molecular weight compounds are removed continuously from the reaction system. When the predetermined acid value is reached, the reaction is halted, the mixture is cooled, and the targeted reaction product is extracted.

The glass transition temperature of the amorphous polyester resin used in the present exemplary embodiment of the present invention, determined in accordance with ASTM D3418-8, is preferably 50° C. or higher, and is even more preferably 55° C. or higher, even more preferably 60° C. or higher, and is most preferably 65° C. or higher but less than 90° C. If the glass transition temperature is less than 50° C., then the resin tends to aggregate during handling or storage, which can cause problems in terms of the storage stability. Furthermore, if the glass transition temperature is 90° C. or higher, then the fixability tends to deteriorate.

Preparation of resin particle dispersions of the crystalline polyester resin and the amorphous polyester resin can be achieved by appropriate adjustment of the acid value of the resin and using an ionic surfactant or the like to effect an emulsification dispersion.

Furthermore, in those cases where the resin is prepared by another method, provided the resin dissolves in an oil-based solvent that exhibits comparatively low solubility in water, a resin particle dispersion can be prepared by dissolving the resin in this type of oil-based solvent, adding the resulting solution to water together with an ionic surfactant and a polymer electrolyte, dispersing the resulting mixture to generate a particle dispersion in water using a dispersion device such as a homogenizer, and then evaporating off the solvent either by heating or under reduced pressure. Furthermore, a resin particle dispersion can also be prepared by adding a surfactant to the resin, and then using either an emulsification dispersion method or a phase inversion emulsification method to disperse the mixture in water with a dispersion device such as a homogenizer.

The particle size of a resin particle dispersion obtained in this manner can be measured, for example, using a laser diffraction particle size distribution analyzer (LA-700, manufactured by Horiba, Ltd.).

As follows is a description of the components used in forming the toner.

Specific examples of suitable colorants include carbon blacks such as furnace black, channel black, acetylene black and thermal black; inorganic pigments such as red iron oxide, iron blue and titanium oxide; azo pigments such as fast yellow, disazo yellow, pyrazolone red, chelate red, brilliant carmine and para brown; phthalocyanine pigments such as copper phthalocyanine and metal-free phthalocyanine; and condensed polycyclic pigments such as flavanthrone yellow, dibromoanthrone orange, perylene red, quinacridone red and dioxazine violet. Further examples include various pigments such as chrome yellow, hansa yellow, benzidine yellow, threne yellow, quinoline yellow, permanent orange GTR, pyrazolone orange, vulkan orange, watchung red, permanent red, DuPont oil red, lithol red, rhodamine B lake, lake red C, rose bengal, aniline blue, ultramarine blue, calco oil blue, methylene blue chloride, phthalocyanine blue, phthalocyanine green, malachite green oxalate, C.I. Pigment Red 48:1, C.I. Pigment Red 122, C.I. Pigment Red 57:1, C.I. Pigment Yellow 12, C.I. Pigment Yellow 97, C.I. Pigment Yellow 17, C.I. Pigment Blue 15:1 and C.I. Pigment Blue 15:3, and these colorants may be used either alone, or in combinations of two or more different colorants.

Specific examples of suitable release agents include natural waxes such as such as carnauba wax, rice wax and candelilla wax; synthetic, mineral or petroleum waxes such as low molecular weight polypropylene, low molecular weight polyethylene, sasol wax, microcrystalline wax, Fischer-Tropsch-wax, paraffin wax and montan wax; and ester waxes such as fatty acid esters and montanate esters, although this is not a restrictive list. These release agents may be used either alone, or in combinations of two or more different materials. From the viewpoint of storage stability, the melting temperature of the release agent is preferably at least 50° C., and is even more preferably 60° C. or higher. Furthermore, from the viewpoint of offset resistance, the melting temperature is preferably no higher than 110° C., and is even more preferably 100° C. or lower.

In addition, various other components may also be added according to need, including internal additives, charge control agents, inorganic powders (inorganic fine particles) and organic fine particles. Examples of suitable internal additives include magnetic materials such as ferrite, magnetite, metals such as reduced iron, cobalt, nickel or manganese, and alloys or compounds containing these metals. Examples of suitable charge control agents include quaternary ammonium salt compounds, nigrosine compounds, dyes formed from complexes of aluminum, iron or chromium, and triphenylmethane-based pigments. Furthermore, inorganic powders are typically added for the purpose of regulating the toner viscoelasticity, and suitable examples include inorganic fine particles of silica, alumina, titania, calcium carbonate, magnesium carbonate, calcium phosphate and cerium oxide, which are typically used as external additives on the toner surface, as described in detail below.

The volume average particle size of a toner according to the present exemplary embodiment is preferably within a range from 3 to 10 μm, even more preferably from 3 to 9 μm, and is most preferably from 3 to 8 μm. Furthermore, the number average particle size of a toner according to the present exemplary embodiment is preferably within a range from 3 to 10 μm, and even more preferably from 3 to 8 μm. If the particle size is too small, then not only does the production become unstable, but the chargeability may be inadequate, and the developing properties may deteriorate. In contrast, if the particle size is too large, the resolution of the image deteriorates.

[Electrostatic Latent Image Developer]

A toner obtained using the method of manufacturing an electrostatic latent image developing toner according to the present invention described above is used as an electrostatic latent image developer. There are no particular restrictions on this developer, other than the requirement to include the above electrostatic latent image developing toner, and other components may be added in accordance with the intended purpose of the developer. In those cases where the electrostatic latent image developing toner is used alone, the developer is prepared as a one-component electrostatic latent image developer, whereas when the toner is used in combination with a carrier, the developer is prepared as a two-component electrostatic latent image developer.

There are no particular restrictions on the carrier, and conventional carriers can be used, including the resin-coated carriers disclosed in Japanese Patent Laid-Open Publication No. Sho 62-39879 and Japanese Patent Laid-Open Publication No. Sho 56-11461.

Specific examples of suitable carriers include the resin-coated carriers listed below. Namely, examples of suitable core particle for these carriers include typical iron powder, ferrite and magnetite structures, and the average particle size of these core particles is typically within a range from about 30 to 200 μm. Examples of the coating resin for these core particles include copolymers of styrenes such as styrene, para-chlorostyrene and α-methylstyrene, α-methylene fatty acid monocarboxylates such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acrylate compounds such as dimethylaminoethyl methacrylate; vinylnitriles such as acrylonitrile and methacrylonitrile; vinylpyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; silicones such as methylsilicone and methylphenylsilicone; and vinyl-based fluorine-containing monomers such as vinylidene fluoride, tetrafluoroethylene and hexafluoroethylene; as well as polyesters containing bisphenol or glycol, epoxy resins, polyurethane resins, polyamide resins, cellulose resins, and polyether resins. These resins may be used either alone or in combinations of two or more different resins. The quantity of the coating resin is preferably within a range from about 0.1 to 10% by weight, and even more preferably from 0.5 to 3.0% by weight, relative to the weight of the carrier. Production of the carrier can be conducted using a heated kneader, a heated Henschel mixer or a UM mixer or the like. Depending on the quantity of the coating resin, a heated fluidized rolling bed or heated kiln or the like may also be used.

In the electrostatic latent image developer, there are no particular restrictions on the mixing ratio between the electrostatic latent image developing toner and the carrier, and this ratio may be selected appropriately in accordance with the intended application.

[Apparatus for Manufacturing Toner]

FIG. 1 shows an example of an apparatus for manufacturing an electrostatic latent image developing toner according to the present exemplary embodiment. In the figure, a stirring tank 10 is used as a reaction tank in which, for example, a resin particle dispersion is mixed with at least a colorant particle dispersion prepared by dispersing a colorant, and in some cases with a release agent particle dispersion prepared by dispersing a release agent, thereby aggregating the resin particles with the pigment particles and the release agent particles to form aggregate particles, and heating is subsequently conducted to fuse the aggregate particles. This stirring tank 10 is provided with a stirring impeller 11 for stirring the solution containing the aggregate particles inside the stirring tank 10, and a drive unit 15 for driving the stirring impeller 11. Furthermore, a jacket 12 for heating and/or cooling the solution containing the aggregate particles inside the stirring tank 10 is provided around the outer periphery of the stirring tank 10. Moreover, the stirring tank 10 is also provided with an accumulation suppression unit that suppresses the accumulation of aggregate particles within one portion of the solution containing the aggregate particles during the fusion step. An example of this accumulation suppression unit is a magnetic field forming unit, which forms a magnetic field either continuously or intermittently, thereby generating a repulsive force between the internal surfaces of the stirring tank 10 and the aggregate particles. As shown in FIG. 1, an example of this magnetic field forming unit includes a coil 13 that is wound around the outer periphery of the stirring tank 10, and an alternating current power source 14 that applies a variable frequency alternating current to the coil 13.

Furthermore, although not shown in the figure, the apparatus for manufacturing an electrostatic latent image developing toner may also be provided with a second magnetic field forming unit that forms a magnetic field either continuously or intermittently within the transport line that transports the toner particles from the stirring tank 10, thereby generating a repulsive force between the internal surfaces of the transport line and the aggregate particles. In a similar configuration to that shown in FIG. 1, an example of this second magnetic field forming unit includes a second coil that is wound around the outer periphery of the transport line, and a second alternating current power source that applies a variable frequency alternating current to the second coil.

The coil 13 and the second coil may be formed of any material capable of forming a magnetic field. Core coils in which a wire is wound around a rod-shaped, E-shaped or comb-shaped core (iron core) may be used, and ferrite is typically used as the core material.

Furthermore, the alternating current power source 14 and the second alternating current power source apply a variable frequency alternating current to the coil 13 and the second coil. The frequency of the alternating current applied by the alternating current power source 14 is typically at least 50 Hz but no more than 5,000 Hz, and the voltage applied to the coil 13 and the second coil can be varied. This variable voltage is typically at least 5 volts but no more than 200 volts.

In an emulsified particle aggregation method, when the toner particles undergo spheronization during the fusion step, particles of large diameter undergo shape change at the slowest rate, meaning the irregularly shaped particles tend to occur mostly at the large diameter end of the particle size distribution. Moreover, in the fusion process, if two or more toner particles are adhered together, then an irregularly shaped particle that retains the shape of the toner particles tends to result, and it is thought that the large diameter, irregularly shaped particles include many particles produced in this manner.

In the fusion step, the toner exhibits electrical repulsive forces due to the acid components and surfactants at the toner surface, so that under conditions of adequate flow, adhesion between multiple adjacent toner particles is comparatively rare. However, in the region near the walls of the stirring tank, which represents the region with the slowest flow rate within the stirring tank, the toner becomes almost stationary, meaning adjacent toner particles may adhere together, and this process is thought to be one reason for the occurrence of large diameter, irregularly shaped toner particles. Increasing the stirring rate is one possible way of ensuring a satisfactory rate of flow in the region near the walls of the stirring tank, but if the stirring rate is increased too far, air may become incorporated within the stirred solution, causing the dispersion of air bubbles that may actually weaken the stirring force and make mixing more difficult, and liquid may splash up and become adhered to the walls of the stirring tank within the gas-phase portion of the tank.

Accordingly, as described above, by imparting an electrical repulsive force to the toner particles by controlling the electrical charge on the walls of the stirring tank, a technique is provided that suppresses the toner from adhering to the surface of the tank wall and suppresses adhesion between adjacent toner particles, even when toner particles approach the walls of the stirring tank where an adequate state of flow is not obtainable. Specifically, by winding the coil 13 around the exterior walls of the stirring tank in a region near the gas-liquid interface inside the tank, which of all the regions near the walls of the stirring tank 10 is the region that suffers from a particularly slow flow rate, and then causing a current to flow through the coil 13 while the frequency is varied during the fusion step, toner particles near the tank walls can be prevented from attaching to the walls and becoming stationary, and the rate at which adjacent toner particles adhere can also be significantly reduced. In the case of the transport line, the positioning of the second coil should be set appropriately in accordance with the length of the line, although the second coil is preferably stretched out with a predetermined spacing between windings. This ensures that adhesion of adjacent toner particles is suppressed within the transport line, enabling suppression of the formation of irregularly shaped toner particles.

Sieving or classification is sometimes used during the toner manufacturing process to remove large diameter particles, but such particles are not necessarily outside the normal particle size distribution for the toner, meaning separation can be difficult. Accordingly, by employing a toner in which the particle size and particle size distribution have been controlled in the manner described above, the sieving and classification steps can be omitted, there is no possibility of normal large diameter, spherical toner particles being removed, and the manufacturing efficiency can be improved.

[Image Forming Apparatus]

Next is a description of an image forming apparatus according to the present exemplary embodiment.

Figure 2:
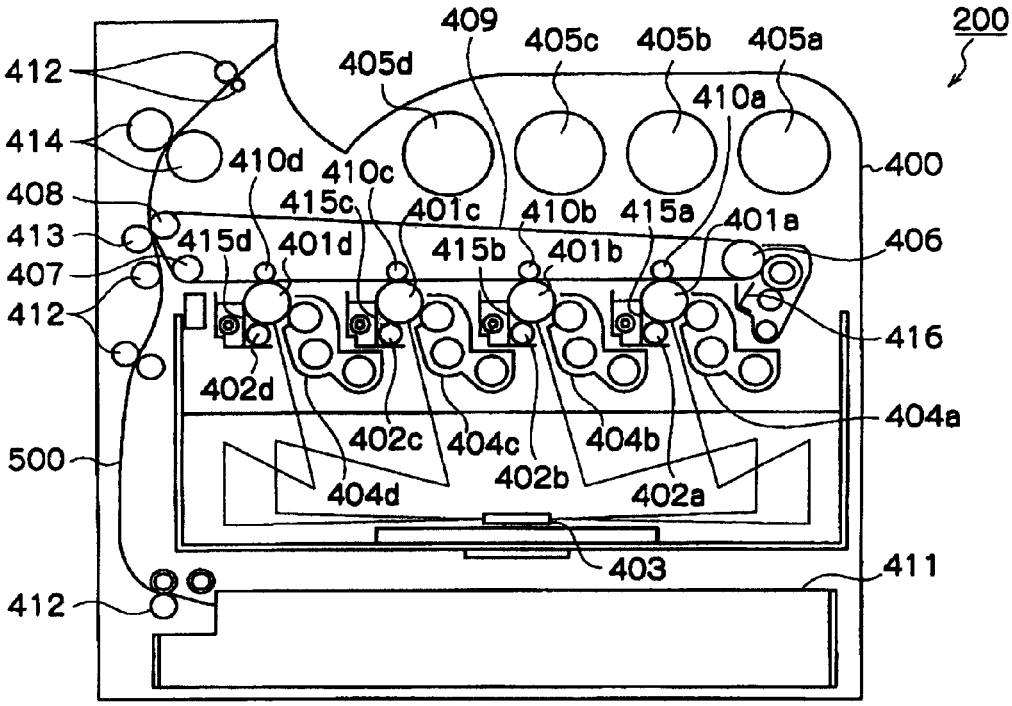
FIG. 2 is a schematic illustration showing a sample configuration of an image forming apparatus used in an exemplary embodiment of the present invention.

FIG. 2 is a schematic illustration showing a sample configuration of an image forming apparatus that forms an image using an image forming method according to the exemplary embodiment of the present invention. The image forming apparatus 200 shown in the figure includes four electrophotographic photoreceptors 401*a* to 401*d* positioned in a mutually parallel arrangement along an intermediate transfer belt 409 inside a housing 400. These electrophotographic photoreceptors 401*a* to 401*d* are configured so that, for example, the electrophotographic photoreceptor 401*a* is capable of forming a yellow image, the electrophotographic photoreceptor 401*b* is capable of forming a magenta image, the electrophotographic photoreceptor 401*c* is capable of forming a cyan image, and the electrophotographic photoreceptor 401*d* is capable of forming a black image.

The electrophotographic photoreceptors 401*a* to 401*d* are each capable of rotating in a predetermined direction (in a counterclockwise direction within the plane of the drawing), and around this rotational direction there are provided charging rollers 402*a* to 402*d*, developing units 404*a* to 404*d*, primary transfer rollers 410*a* to 410*d*, and cleaning blades 415*a* to 415*d* respectively. The four colored toners, namely the black, yellow, magenta and cyan toners housed within toner cartridges 405*a* to 405*d* can be supplied to the developing units 404*a* to 404*d* respectively. Furthermore, the primary transfer rollers 410*a* to 410*d* contact the respective electrophotographic photoreceptors 401*a* to 401*d* across the intermediate transfer belt 409.

An exposure unit 403 is also positioned at a predetermined location inside the housing 400, and the light beam emitted from the exposure unit 403 is able to be irradiated onto the surfaces of the charged electrophotographic photoreceptors 401*a* to 401*d*. Accordingly, rotating the electrophotographic photoreceptors 401*a* to 401*d* enables the processes of charging, exposure, developing, primary transfer and cleaning to be conducted in sequence, thereby transferring and superimposing the toner image for each color onto the intermediate transfer belt 409.

In this description, the charging rollers 402*a* to 402*d* are used for bringing a conductive member (the charging roller) into contact with the surface of the respective electrophotographic photoreceptor 401*a* to 401*d*, thereby applying a uniform voltage to the photoreceptor and charging the photoreceptor surface to a predetermined potential (the charging step). Besides the charging rollers shown in the present exemplary embodiment, charging may also be conducted using contact charging systems that employ charging brushes, charging films or charging tubes. Furthermore, charging may also be conducted using non-contact systems that employ a corotron or a scorotron.

The exposure unit 403 may employ an optical device that enables a light source such as a semiconductor laser, an LED (light emitting diode) or a liquid crystal shutter to be irradiated onto the surface of the electrophotographic photoreceptors 401*a* to 401*d* with a desired image pattern. Of these possibilities, if an exposure unit that is capable of irradiating incoherent light is used, then the generation of interference patterns between the conductive base material and the photosensitive layer of the electrophotographic photoreceptors 401*a* to 401*d* can be prevented.

For the developing units 404*a* to 404*d*, typical developing units that use an aforementioned two-component electrostatic latent image developer to conduct developing via either a contact or non-contact process may be used (the developing step). There are no particular restrictions on these types of developing units, provided they use a two-component electrostatic latent image developer, and appropriate conventional units may be selected in accordance with the desired purpose. In the primary transfer step, a primary transfer bias of the reverse polarity to the toner supported on the image holding member is applied to the primary transfer rollers 410*a* to 410*d*, thereby effecting sequential primary transfer of each of the colored toners to the intermediate transfer belt 409.

The cleaning blades 415 to 415*d* are used for removing residual toner adhered to the surfaces of the electrophotographic photoreceptors following the transfer step, and the resulting surface-cleaned electrophotographic photoreceptors are then reused within the above image forming process. Suitable materials for the cleaning blades include urethane rubbers, neoprene rubbers and silicone rubbers.

The intermediate transfer belt 409 is supported at a predetermined level of tension by a drive roller 406, a backup roller 408 and a tension roller 407, and can be rotated without slack by rotation of these rollers. Furthermore, a secondary transfer roller 413 is positioned so as to contact the backup roller 408 across the intermediate transfer belt 409.

By applying a secondary transfer bias of the reverse polarity to the toner on the intermediate transfer belt to the secondary transfer roller 413, the toner undergoes secondary transfer from the intermediate transfer belt to the recording medium. After passing between the backup roller 408 and the secondary transfer roller 413, the intermediate transfer belt 409 is surface-cleaned by either a cleaning blade 416 positioned near the driver roller 406 or a charge neutralizing device (not shown in the drawing), and is then reused in the next image forming process. Furthermore, a tray (a transfer target medium tray) 411 is provided at a predetermined position within the housing 400, and a transfer target medium 500 such as paper stored within this tray 411 is fed by feed rollers 412 so as to pass between the intermediate transfer belt 409 and the secondary transfer roller 413, and then between two mutually contacting fixing rollers 414, before being discharged from the housing 400.

An image forming method according to the present exemplary embodiment includes: forming an electrostatic latent image on the surface of a latent image holding member; developing the electrostatic latent image formed on the surface of the latent image holding member using a developer supported on a developer carrier, thereby forming a toner image; transferring the toner image formed on the surface of the latent image holding member to the surface of a transfer target; and heat fixing the toner image that has been transferred to the surface of the transfer target, wherein the developer contains at least a toner for developing an electrostatic latent image according to the present invention. The developer may be either a one-component system or a two-component system.

Each of the above steps can use conventional processes from known image forming methods.

An electrophotographic photoreceptor or a dielectric recording material may be used as the latent image holding member. In the case of an electrophotographic photoreceptor, the surface of the electrophotographic photoreceptor is charged uniformly using a corotron charger or a contact charger or the like, and is then exposed to form an electrostatic latent image (the latent image-forming step). Subsequently, toner particles are adhered to the electrostatic latent image by bringing the image either into contact with, or into close proximity to, a developing roller with a developer layer formed on the surface thereof, thereby forming a toner image on the electrophotographic photoreceptor (the developing step). The thus formed toner image is then transferred to the surface of a transfer target material such as a sheet of paper using a corotron charger or the like (the transfer step). The toner image that has been transferred to the surface of the transfer target is subsequently subjected to heat fixing using a fixing unit, thereby forming the final toner image.

During heat fixing by the above fixing unit, a release agent is usually supplied to the fixing member of the above fixing unit in order to prevent offset problems and the like.

There are no particular restrictions on the method used for supplying the release agent to the surface of the roller or belt that functions as the fixing member during heat fixing, and suitable methods include a pad system that uses a pad impregnated with the liquid release agent, a web system, a roller system, and a non-contact shower system (a spray system), although of these, a web system or roller system is preferred. These systems offer the advantages that the release agent can be supplied uniformly, and the quantity of release agent supplied can be readily controlled. If a shower system is used, then a separate blade or the like should be used to ensure that the release agent is supplied uniformly across the entire fixing member.

[Other Preferred Exemplary Embodiments]

(i) An apparatus for manufacturing an electrostatic latent image developing toner wherein the magnetic field forming unit includes a coil that is wound around the outer periphery of the stirring tank, and an alternating current power source that causes an alternating current to flow through the coil.

(ii) An apparatus for manufacturing an electrostatic latent image developing toner wherein the second magnetic field forming unit includes a second coil that is wound around the outer periphery of the transport line, and a second alternating current power source that causes an alternating current to flow through the second coil.

Examples

As follows is a more detailed description of the present invention based on a series of examples, although the present invention is in no way limited by the examples presented below.

In the following examples, the various measurements are conducted using the methods described below.

—Method of Measuring Sphericity and Average Sphericity of Toner Particles

The sphericity can be measured using a flow-type particle image analyzer FPIA-3000 device (manufactured by Sysmex Corporation), and is calculated using the formula shown below.

Sphericity=(Circumference of circle having the same projected area as that of the particle image)/(actual circumference of projected particle image)

The average sphericity can also be measured using a flow-type particle image analyzer FPIA-3000 device (manufactured by Sysmex Corporation). The average sphericity is determined in the manner described below. Namely, the average sphericity is simply the average value of the above sphericity values across the sample population.

The equivalent spherical diameter is defined using the formula below.

Equivalent spherical diameter=$2\pi$(sum of particle surface areas/$\pi$)$^{1/2}$ —Method of Calculating the Accumulated Equivalent Spherical Diameter on a Number Basis—

Using a flow-type particle image analyzer FPIA-3000 device (manufactured by Sysmex Corporation), the diameter and shape of individual particles are measured, a sphericity frequency distribution is prepared with the particle diameter along the horizontal axis and the sphericity along the vertical axis, and the total number of particles is then accumulated, beginning with the smallest diameter particles and moving towards the larger diameter particles.

—Method of Determining Shape Distribution—

Using a flow-type particle image analyzer FPIA-3000 device (manufactured by Sysmex Corporation), the diameter and shape of individual particles are measured, a sphericity frequency distribution is prepared with the particle diameter along the horizontal axis and the sphericity along the vertical axis, and the proportion of the total number of toner particles accounted for by toner particles having a sphericity within a specific range is calculated.

—Method of Measuring Particle Size and Particle Size Distribution—

Next is a description of particle size (also referred to as particle diameter) and particle size distribution (also referred to as particle diameter distribution).

In those cases where the particle size to be measured is 2 μm or greater, measurement is conducted using a Coulter Multisizer-II (manufactured by Beckman Coulter, Inc.), using ISOTON-II (manufactured by Beckman Coulter, Inc.) as the electrolyte.

The measurement method involves adding from 0.5 to 50 mg of the measurement sample to a surfactant as the dispersant (2 ml of a 5% aqueous solution of a sodium alkylbenzenesulfonate is preferred), and then adding this sample to 100 ml of the above electrolyte.

The electrolyte containing the suspended sample is subjected to dispersion treatment for about one minute in an ultrasonic disperser, and then using the aforementioned Coulter Multisizer-II, the particle size distribution is measured for particles from 2 to 60 μm using an aperture size of 100 μm, and the volume average particle size distribution and the number average particle size distribution are determined. The number of particles measured is 50,000.

Furthermore, the toner particle size distribution is determined in the following manner. Namely, the previously measured particle size distribution is divided into particle size ranges (channels), and a volume cumulative distribution curve is drawn beginning at the smaller particle sizes. On this curve, the particle size at the point where the accumulated particle volume reaches 16% is defined as D16v, and the particle size at the point where the accumulated particle volume reaches 50% is defined as D50v. Similarly, the particle size at the point where the accumulated particle volume reaches 84% is defined as D84v.

In the present invention, the volume average particle size refers to D50v, and the volume average particle size index GSDv is calculated using the formula shown below.

$$GSDv=\{(D84v)/(D16v)\}^{0.5}$$

In those cases where the particle size to be measured is less than 2 μm, measurement is conducted using a laser diffraction particle size distribution analyzer (LA-700, manufactured by Horiba, Ltd.). The measurement method involves adjusting the dispersion-state sample so that the solid fraction of the sample is about 2 g, and then adding ion-exchanged water to make the sample up to about 40 ml. This sample is then added to the cell in sufficient quantity to generate a suitable concentration, the sample is then left to stand for about 2 minutes until the concentration within the cell has substantially stabilized, and the measurement is then conducted. The volume average particle size for each of the obtained channels is accumulated beginning at the smaller volume average particle sizes, and the point where the accumulated value reaches 50% is defined as the volume average particle size.

In the case of the measurement of a powder of an external additive or the like, 2 g of the sample for measurement is added to a surfactant (50 ml of a 5% aqueous solution of a sodium alkylbenzenesulfonate is preferred), and the resulting mixture is dispersed for two minutes using an ultrasonic disperser (1,000 Hz), thereby yielding a sample. This sample is then measured in the same manner as the dispersion described above.

—Method of Measuring Toner Shape Factor SF1—

The shape factor SF1 of a toner is a shape factor SF that indicates the degree of unevenness on the surface of the toner particles, and is calculated using the formula shown below.

$$SF1=(ML^2/A)\times(\pi/4)\times100$$

In this formula, ML represents the maximum length of a toner particle, and A represents the projected area of the toner particle. Measurement of the shape factor SF1 is conducted by first loading an optical microscope image of a toner scattered on a slide glass into an image analyzer via a video camera, subsequently calculating the SF value for at least 50 toner particles, and then determining the average value of these calculated shape factor values.

—Method of Measuring Glass Transition Temperature—

The glass transition temperature of a toner is determined using a DSC (differential scanning calorimetry) measurement method, and is determined from the subjective maximum peak, measured in accordance with ASTM D3418-8.

Measurement of the subjective maximum peak can be conducted using a DSC-7 device manufactured by PerkinElmer Inc. In this device, temperature correction at the detection unit is conducted using the melting temperatures of indium and zinc, and correction of the heat quantity is conducted using the heat of fusion of indium. The sample is placed in an aluminum pan, and using an empty pan as a control, measurement is conducted at a rate of temperature increase of 10° C./minute.

—Method of Measuring Molecular Weight and Molecular Weight Distribution for Toners and Resin Particles—

Measurements of the molecular weight distribution are conducted under the following conditions. Namely, GPC is conducted using devices HLC-8120GPC and SC-8020 (manufactured by Tosoh Corporation), two columns (TSK-gel, Super HM-H, manufactured by Tosoh Corporation, 6.0 mmID×15 cm), and using THF (tetrahydrofuran) as the eluent. Testing is conducted under conditions including a sample concentration of 0.5%, a flow rate of 0.6 ml/minute, a sample injection volume of 10 μl, and a measurement temperature of 40° C., using an IR detector. Furthermore, the calibration curve is prepared using 10 polystyrene TSK standards manufactured by Tosoh Corporation: A-500, F-1, F-10, F-80, F-380, A-2500, F-4, F-40, F-128 and F-700.

Next is a description of more specific comparative examples and examples according to the present invention, although the present invention is in no way limited by the content of the examples presented below. In the following description, unless stated otherwise, the units "parts" refer to "parts by weight".

[Evaluation of Toner Production Examples and Developers]

(Preparation of Resin Particle Dispersion 1)

A polymerization reaction tank is charged with 370 parts by weight of ion-exchanged water and 0.3 parts by weight of a surfactant, and the temperature is raised to 75° C. with constant stirring. Meanwhile, the components listed below are combined in an emulsification tank and mixed thoroughly, yielding an emulsion.

170 parts by weight of ion-exchanged water,
2 parts by weight of a nonionic surfactant (Nonipol 400, manufactured by Sanyo Chemical Industries, Ltd.),
3 parts by weight of an anionic surfactant (Neogen SC, manufactured by Dai-ichi Kogyo Seiyaku Co., Ltd.),
300 parts by weight of styrene,
90 parts by weight of n-butyl acrylate,
11 parts by weight of acrylic acid,
6 parts by weight of dodecanethiol, and
1.5 parts by weight of 1,10-decanediol diacrylate Once the temperature within the reaction tank has stabilized, 2% of the total weight of the prepared emulsion is added to the reaction tank over a period of 10 minutes, and 5 parts by weight of ammonium persulfate diluted 5-fold with ion-exchanged water is then also added to the reaction tank over a period of 10 minutes. The resulting mixture is then held at that temperature for 20 minutes. Subsequently, the remaining emulsion is added to the reaction tank over a period of 3 hours, and following completion of the addition, the temperature is maintained for a further 3 hours, thereby completing the reaction. The weight average molecular weight of the obtained resin is 35,000, and the volume average particle size is 210 nm.

(Preparation of Resin Particle Dispersion 2)

—Synthesis of Crystalline Polyester Resin 1—

A heat-dried three-necked flask is charged with 120.0 parts by weight of 1,10-decanediol, 70.0 parts by weight of dimethyl sebacate, 10.0 parts by weight of sodium dimethyl 5-sulfoisophthalate, 4 parts by weight of dimethylsulfoxide, and 0.03 parts by weight of dibutyltin oxide as a catalyst, a reduced pressure operation is used to replace the air inside the flask with an inert atmosphere of nitrogen gas, and the mixture is then stirred for 3 hours at 180° C. using a mechanical stirrer. The dimethylsulfoxide is then removed by distillation under reduced pressure, 23.0 parts by weight of dimethyl dodecanedioate is added under a stream of nitrogen, and the resulting mixture is stirred for a further 1 hour at 180° C.

Subsequently, the temperature is raised gradually to 230° C. under reduced pressure, and stirring is continued for a further 60 minutes. Once a viscous state is reached, the mixture is air-cooled to halt the reaction, thus completing synthesis of a crystalline polyester resin 1.

Measurement of the weight average molecular weight (Mw) of the thus obtained crystalline polyester resin 1 using a gel permeation chromatography measurement (referenced against polystyrene standards) reveals a value of 26,000.

Furthermore, measurement of the melting temperature (Tm) of the resin using a differential scanning calorimeter (DSC) and the measurement method described above reveals a clear peak, with a peak top temperature of 75° C.

—Synthesis of Amorphous Polyester Resin 1—

A heat-dried three-necked flask is charged with:
112 parts by weight of dimethyl naphthalenedicarboxylate,
97 parts by weight of dimethyl terephthalate,
221 parts by weight of a 2-mol ethylene oxide adduct of bisphenol A,
80 parts by weight of ethylene glycol, and
0.07 parts by weight of tetrabutoxy titanate,
and a transesterification reaction is then conducted by heating the mixture at 220° C. for a period of 180 minutes. Subsequently, the reaction is continued for 60 minutes at 220° C. with the system pressure reduced to a level from 1 to 10 mmHg (1 to 10 Torr), thereby yielding a amorphous polyester resin 1. The glass transition temperature of this polyester resin is 65° C., and the weight average molecular weight is 11,000.

—Preparation of Resin Particle Dispersion 2—

The resins obtained in the above syntheses of the crystalline polyester resin and amorphous polyester resin are ground coarsely using a hammer mill, and subsequently used to prepare resin particle dispersions.

A 2 L separable flask fitted with an anchor impeller that imparts a stirring action, a reflux condenser, and a pressure reduction device based on a vacuum pump is charged with 50 parts by weight of ethyl acetate, 110 parts by weight of IPA (isopropyl alcohol) is added, and the flask is then flushed with $N_2$ at a flow rate of 0.2 L/minute to replace the air inside the system with $N_2$. Subsequently, an oil bath is used to raise the temperature inside the system to 60° C., while 20 parts by weight of the crystalline polyester resin 1 and 190 parts by weight of the amorphous polyester resin 1 are added gradually and dissolved under constant stirring. Subsequently, 20 parts by weight of 10% ammonia water is added to the system, and a metered pump is then used to introduce 460 parts by weight of ion-exchanged water at a rate of 9.6 g/minute under constant stirring. Once the emulsification system has developed a milky white appearance and the stirring viscosity has fallen, the emulsification is deemed to be complete.

Subsequently, the pressure is reduced to 50 Torr, and stirring is continued for a further 40 minutes. 50 parts by weight of 60° C. pure water is then added to the system, and stirring under reduced pressure is continued for a further 20 minutes. The point where the reflux quantity reaches 210 parts by weight is deemed the end point, and heating is then halted and the flask is cooled to room temperature with continued stirring. The particle size of the resulting fine resin particles is measured using a laser diffraction/scattering particle size distribution analyzer (LA-920, manufactured by Horiba, Ltd.). The volume average particle size of the obtained emulsified fine resin particles is 220 nm.

(Preparation of Pigment Dispersions)

—Preparation of Cyan Colorant Dispersion—

30 parts be weight of C.I. Pigment Blue 15:3 (manufactured by Dainichiseika Color & Chemicals Mfg. Co., Ltd.), 3 parts by weight of an ionic surfactant (Neogen RK, manufactured by Dai-ichi Kogyo Seiyaku Co., Ltd.), and 70 parts by weight of ion-exchanged water The above components are mixed together and then passed 10 times through an ultrasonic disperser, yielding a pigment dispersion. The number average particle size of the dispersed pigment is 130 nm.

—Preparation of Black Colorant Dispersion—

90 parts by weight of a carbon black (Regal 330, manufactured by Cabot Corporation, primary particle size: 25 nm, BET specific surface area: 94 $m^2/g$), 10 parts by weight of an anionic surfactant (Neogen SC, manufactured by Dai-ichi Kogyo Seiyaku Co., Ltd.), and 240 parts by weight of ion-exchanged water The above components are mixed together and then treated under the same conditions as those described for the cyan colorant dispersion, yielding a black colorant dispersion. The number average particle size of the colorant in the black colorant dispersion is 150 nm.

—Preparation of Yellow Colorant Dispersion—

50 parts be weight of C.I. Pigment Yellow 74 (manufactured by Dainichiseika Color & Chemicals Mfg. Co., Ltd.), 5 parts by weight of an ionic surfactant (Neogen RK, manufactured by Dai-ichi Kogyo Seiyaku Co., Ltd.), and 195 parts by weight of ion-exchanged water The above components are mixed together and then dispersed for 10 minutes using an Ultimaizer (manufactured by Sugino Machine Ltd.), yielding a colorant dispersion with a number average particle size of 168 nm.

—Preparation of Magenta Colorant Dispersion—

50 parts by weight of C.I. Pigment Red 122 (manufactured by Clariant Ltd.), 6 parts by weight of an ionic surfactant (Neogen RK, manufactured by Dai-ichi Kogyo Seiyaku Co., Ltd.), and 200 parts by weight of ion-exchanged water The above components are mixed together and then dispersed for 10 minutes using an Ultimaizer (manufactured by Sugino Machine Ltd.), yielding a colorant dispersion with a number average particle size of 185 nm and a solid fraction of 23.5 parts by weight.

(Preparation of Release Agent Dispersion)

30 parts by weight of POLYWAX 725 (manufactured by Baker Petrolite Co., Ltd.), 2 parts by weight of a cationic surfactant (Sanisol B50, manufactured by Kao Corporation), and 70 parts by weight of ion-exchanged water The above components are heated to 120° C., treated with a high-pressure homogenizer at 50 MPa, and then cooled rapidly, thereby yielding a release agent dispersion. The volume average particle size of the dispersed wax is 250 nm.

(Preparation of Toner Dispersion 1)

Using a reaction tank having a jacket that extends from the bottom of the stirring tank to a height equivalent to 60% of the entire height of the stirring tank, a coil for carrying an electrical current is wound around the tank, with no gap between adjacent windings, beginning at a point at the top edge of the jacket and extending for a height equivalent to 5% of the total height of the tank, and this coil is connected to a power source capable of supplying a current for which the frequency is able to be constantly altered. The components listed below are placed in the stirring tank and stirred thoroughly. The range for the modulated frequency is from at least 500 Hz to no more than 1,000 Hz.

300 parts by weight of ion-exchanged water, 135 parts by weight of the resin particle dispersion 1, 18 parts by weight of a pigment dispersion, and 30 parts by weight of the release agent dispersion.

Subsequently, with the mixture undergoing dispersion using an inline disperser, 18 parts by weight of a 1% aqueous solution of a coagulant (polyaluminum chloride (manufactured by Asada Kagaku Co., Ltd.)) is added, and following further dispersion treatment, the temperature of the dispersion is increased gradually under thorough stirring, and after the temperature is held at 50° C. for 2 hours, the volume average particle size of the aggregate particles is 5.4 μm.

At this point, a further 70 parts by weight of the resin particle dispersion 1 is added gently over a period of 10 minutes, and following maintenance of the conditions for a further one hour, the volume average particle size of the aggregate particles is 6.0 μm. Subsequently, the pH inside the reaction tank is adjusted to 7.0, current supply to the external coil is started, the temperature is raised gradually to 95° C. and held at that temperature for 2 hours to effect fusion of the aggregate particles, and the mixture is then cooled to 40° C., yielding a toner particle dispersion 1.

(Preparation of Toner Dispersion 2)

With the exception of altering the hold time during the fusion step to 2.7 hours, a toner is prepared in the same manner as the toner dispersion 1, yielding a toner dispersion 2.

(Preparation of Toner Dispersion 3)

With the exception of altering the hold time during the fusion step to 3.6 hours, a toner is prepared in the same manner as the toner dispersion 1, yielding a toner dispersion 3.

(Preparation of Toner Dispersion 4)

With the exception of not supplying a current to the external coil, a toner is prepared in the same manner as the toner dispersion 1, yielding a toner dispersion 4.

(Preparation of Toner Dispersion 5)

With the exception of altering the hold time during the fusion step to 1.7 hours, a toner is prepared in the same manner as the toner dispersion 1, yielding a toner dispersion 5.

(Preparation of Toner Dispersion 6)

With the exception of altering the hold time during the fusion step to 4 hours, a toner is prepared in the same manner as the toner dispersion 1, yielding a toner dispersion 6.

(Preparation of Toner Dispersion 7)

With the exceptions of altering the range for the modulated frequency in the fusion step to a range from at least 50 Hz to no more than 100 Hz, and altering the hold time to 4 hours, a toner is prepared in the same manner as the toner dispersion 1, yielding a toner dispersion 7.

(Preparation of Toner Dispersion 8)

—Preparation of Coagulant Aqueous Solution—

0.18 parts by weight of polyaluminum chloride (PAC, manufactured by Asada Kagaku Co., Ltd.) and 1.80 parts by weight of a 0.1% aqueous solution of nitric acid The above components are placed in a bottle and mixed together thoroughly, yielding an aqueous solution of polyaluminum chloride that functions as a coagulant aqueous solution.

80 parts by weight of the resin particle dispersion 2, 40 parts by weight of the cyan colorant dispersion, 60 parts by weight of the release agent dispersion, and
0.41 parts by weight of the aqueous solution of polyaluminum chloride A mixture of the above components is placed inside the reaction tank and stirred thoroughly. Subsequently, the mixture is transported to a disperser via a valve in the bottom of the reaction tank and subjected to a dispersion treatment, and having passed through the disperser, the mixture is returned to the upper portion of the reaction tank. This circulation of the mixture is continued for 20 minutes. The mixture inside the reaction tank is then heated to 47° C., and this temperature is maintained for a period of 150 minutes. Following this hold period of 150 minutes, a further 31 parts by weight of the resin particle dispersion 2 is added gradually to the mixture. The pH inside the reaction tank is then adjusted to a value of 8.0 using a 0.5 mol/L aqueous solution of sodium hydroxide, current supply to the external coil is started, and the temperature is raised to 90° C. with constant stirring and then held at 90° C. for 3 hours to effect fusion of the aggregate particles. The mixture is then cooled to 40° C. with continued stirring. The reaction tank used has a jacket that extends from the bottom of the stirring tank to a height equivalent to 60% of the entire height of the stirring tank, a coil for carrying an electrical current is wound around the tank, with no gap between adjacent windings, beginning at a point at the top edge of the jacket and extending for a height equivalent to 5% of the total height of the tank, and this coil is connected to a power source capable of supplying a current for which the frequency is able to be constantly altered. The range for the modulated frequency is from at least 500 Hz to no more than 1,000 Hz.

Following completion of the reaction, the reaction mixture is cooled, filtered using a Nutsche suction filtration device, washed thoroughly with ion-exchanged water, and then subjected to a solid-liquid separation. The resulting product is re-dispersed in 3 L of 40° C. ion-exchanged water, and is then washed by stirring at 300 rpm for 15 minutes.

This filtration and re-dispersion operation is repeated 5 times, and then a solid-liquid separation is conducted by Nutsche suction filtration using a No. 5A filter paper. The toner is then subjected to continuous vacuum drying for 12 hours at 40° C.

The toner volume average particle size D50 within the toner dispersion 8 is 6.3 μm, and the particle size distribution index GSDv is 1.23.

(Preparation of Toner Dispersion 9)

With the exception of changing the colorant dispersion to the black colorant dispersion, a toner is prepared in the same manner as the toner dispersion 8, yielding a toner dispersion 9.

(Preparation of Toner Dispersion 10)

With the exception of changing the colorant dispersion to the yellow colorant dispersion, a toner is prepared in the same manner as the toner dispersion 8, yielding a toner dispersion 10.

(Preparation of Toner Dispersion 11)

With the exception of changing the colorant dispersion to the magenta colorant dispersion, a toner is prepared in the same manner as the toner dispersion 8, yielding a toner dispersion 11.

(Post-treatment of Toners and Preparation of Developers)

Each of the prepared toner particle dispersions is filtered through a 20 μm Nylon mesh, washed thoroughly with ion-exchanged water, and then dried using a flash dryer.

100 parts by weight of each toner is mixed with 2 parts by weight of a hydrophobic titanium oxide (T805, manufactured by Nippon Aerosil Co., Ltd., average particle size: 0.021 μm) and 1 part by weight of a hydrophobic silica (RX50, manufactured by Nippon Aerosil Co., Ltd., average particle size: 0.040 μm), thereby yielding an external additive toner. Subsequently, 1.5 parts by weight of each of the external additive toners is mixed with 30 parts by weight of ferrite particles coated with a styrene-methyl methacrylate resin (average particle size: 35 μm), yielding a series of developers.

(Evaluation of Toners)

Using each of the prepared developers and the modified DocuCentre Color 400CP apparatus shown in FIG. 2 (manufactured by Fuji Xerox Co., Ltd.), image formation is conducted onto color paper (J-paper, manufactured by Fuji Xerox Co., Ltd.), with the quantity of toner adjusted to 6 g/cm$^2$ 6 g/m2 for the 10 cm leading edge of the image. Following output, an external fixing unit is used to conduct fixing, with the peripheral velocity of the developer supports that support the developers provided in the developing units 404*a* to 404*d* set to a value of 1,000 mm/second. Following printing of 10,000 copies, the level of contamination inside the developing unit is evaluated. The contamination of the developer is graded visually, with the state prior to printing graded as 0, and the most severe contamination graded as 5.

TABLE 1

| | Toner dispersion | Alternating current frequency (Hz) | Average sphericity | Proportion of particles above accumulated equivalent spherical diameter of 90% (%) | Proportion of particles having a sphericity of at least 0.90 but less than 0.95 (%) | Proportion of particles having a sphericity of at least 0.95 but no more than 1.00 (%) | Developing unit contamination grade |
|---|---|---|---|---|---|---|---|
| Example 1 | Toner 1 | 500-1000 | 0.945 | 2.7 | 36 | 63 | 2 |
| Example 2 | Toner 2 | 500-1000 | 0.958 | 1.5 | 32 | 66 | 2 |
| Example 3 | Toner 3 | 500-1000 | 0.975 | 1.0 | 26 | 73 | 1 |
| Example 4 | Toner 6 | 500-1000 | 0.982 | 0.7 | 22 | 77 | 2 |
| Example 5 | Toner 7 | 50-100 | 0.974 | 2.9 | 24 | 75 | 3 |
| Example 6 | Toner 8 | 500-1000 | 0.960 | 2.7 | 28 | 71 | 2 |
| Example 7 | Toner 9 | 500-1000 | 0.951 | 1.8 | 34 | 65 | 1 |
| Example 8 | Toner 10 | 500-1000 | 0.955 | 1.9 | 33 | 67 | 2 |
| Example 9 | Toner 11 | 500-1000 | 0.949 | 2.6 | 35 | 64 | 2 |
| Comparative example 1 | Toner 4 | No current | 0.948 | 3.3 | 38 | 60 | 4 |
| Comparative example 2 | Toner 5 | No current | 0.938 | 5.4 | 43 | 55 | 5 |

The electrostatic latent image developing toner of the present invention is particularly useful for applications of electrophotographic methods and electrostatic recording methods.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method for forming an electrostatic latent image developing toner, the method comprising mixing in a stirring tank a resin particle dispersion with at least a colorant particle dispersion prepared by dispersing a colorant and in some cases with a release agent particle dispersion prepared by dispersing a release agent;

aggregating in the stirring tank the resin particles with the pigment particles and the release agent particles to form aggregate particles; and then conducting heating in the stirring tank to fuse the aggregate particles, wherein the method further comprises during a fusion step, suppressing with an accumulation suppression unit accumulation of aggregate particles within the stirring tank containing the aggregate particles, wherein the accumulation suppression unit is a magnetic field forming unit that forms a magnetic field either continuously or intermittently, wherein the developing toner has an average sphericity is at least 0.94 but no more than 0.98, a proportion of particles of which accumulation of a circle-corresponding diameter on a number basis is more than 90% and a sphericity is less than 0.92 is less than 3% by number of particles of the entire toner, a proportion of particles having a sphericity of at least 0.90 but less than 0.95 is at least 20% but no more than 40% of the entire toner, and a proportion of particles having a sphericity of at least 0.95 but no more than 1.00 is at least 60% but no more than 80% of the entire toner.

2. The method according to claim 1, wherein the toner comprises a crystalline polyester resin.

3. The method according to claim 2, wherein the crystalline polyester resin comprises alkyl groups of about 6 or more carbon atoms.

4. The method according to claim 2, wherein a melting temperature of the crystalline polyester resin is within a range from about 50° C. to about 120° C.

5. The method according to claim 1, wherein the toner comprises a release agent.

6. The method according to claim 5, wherein a melting temperature of the release agent is within a range from about 50° C. to about 110° C.

7. The method according to claim 1, wherein a volume average particle size of the toner is within a range from about 3 μm to about 10 μm.

8. The method according to claim 1, wherein the method further comprises forming with a second magnetic field forming unit a magnetic field either continuously or intermittently within a transport line that transports toner particles from the stirring tank.

* * * * *